United States Patent [19]

Orenstein

[11] 4,372,554

[45] Feb. 8, 1983

[54] ELECTRONIC QUESTION AND ANSWER GAME

[76] Inventor: Henry Orenstein, 136 Lakeside Ave., Verona, N.J. 07044

[21] Appl. No.: 118,992

[22] Filed: Feb. 6, 1980

[51] Int. Cl.[3] ..... A63F 9/18

[52] U.S. Cl. ..... 273/1 E; 273/237; 434/308; 434/321; 434/352

[58] Field of Search ..... 179/1 SM, 1 SG, 1 VE; 273/1 E, 85 G, 237, DIG. 28; 434/307, 308, 309, 310, 314, 319, 335

[56] References Cited

U.S. PATENT DOCUMENTS

| | | | |
|---|---|---|---|
| 3,141,243 | 7/1964 | Chapman et al. . | |
| 3,210,864 | 10/1965 | Tillotson et al. . | |
| 3,255,536 | 6/1966 | Livingston . | |
| 3,371,321 | 2/1968 | Adams . | |
| 3,484,950 | 12/1969 | Serrell et al. . | |
| 3,537,190 | 11/1970 | Serrell et al. . | |
| 3,623,157 | 11/1971 | Stapleford . | |
| 3,623,238 | 11/1971 | Laplume et al. . | |
| 3,718,984 | 3/1973 | Hewitt . | |
| 3,718,985 | 3/1973 | Hewitt . | |
| 3,774,316 | 11/1973 | Meir . | |
| 3,812,533 | 5/1974 | Kimura et al. . | |
| 3,913,135 | 10/1975 | Damlamian . | |
| 3,932,886 | 1/1976 | Ohms et al. . | |
| 3,947,972 | 4/1976 | Freeman | 434/321 |
| 3,953,929 | 5/1976 | Hansel . | |
| 3,996,671 | 12/1976 | Foster . | |
| 4,044,475 | 8/1977 | Fujisawa . | |
| 4,055,907 | 11/1977 | Henson . | |
| 4,078,318 | 3/1978 | Shivers . | |
| 4,094,079 | 6/1978 | Dorsett | 434/307 |
| 4,126,851 | 11/1978 | Okor | 273/85 G X |
| 4,156,928 | 5/1979 | Inose et al. | 364/900 |
| 4,194,198 | 3/1980 | Baer et al. | 273/85 G X |

*Primary Examiner*—Vance Y. Hum

*Attorney, Agent, or Firm*—Brumbaugh, Graves, Donohue & Raymond

[57] ABSTRACT

A game apparatus makes use of a tape recorder and a programmed microprocessor to provide a game sequence in accordance with data recorded on a magnetic tape and using message outputs in the form of a voice recording on the same magnetic tape.

1 Claim, 7 Drawing Figures

Microfiche Appendix Included
(2 Microfiche, 86 Pages)

ELECTRONIC QUESTION AND ANSWER GAME

A Microfiche Appendix containing eighty-six frames on two cards is included in the specification and is hereafter referred to as Appendix I.

BACKGROUND OF THE INVENTION

This invention relates to electronic games, particularly to electronic games which make use of microprocessors and tape players.

There have been known in the prior art, game apparatus which makes use of microprocessors which are programmed to engage the operator or operators in a game sequence, and which respond to the operators depressing input data buttons. There have also been known in the prior art apparatus which uses a magnetic tape and responds to inputs by the operator or operators of the device in order to select an audible output from one of multiple possible outputs, previously recorded on the tape. One such device is a teaching apparatus described in U.S. Pat. No. 3,947,972 to Freeman.

In accordance with the Freeman disclosure, there is provided a multi-channel tape wherein a question is recorded on one track of the tape, and wherein the operator or operators can depress a button to respond to playing of the recorded question. The button depression response by the game operator causes the machine to play a selected pre-recorded message from one of the multiple channels on the tape. Thus, if the operator answers a question correctly, the machine might say "Congratulations, you have answered correctly". On the other hand, if rhe operator answers the question incorrectly, the machine might say "I am sorry you were wrong, the correct answer is—".

It is an object of the present invention to provide a new and improved game apparatus wherein the use of a microprocessor operating under a control program is combined with the use of a sound recording having pre-recorded alternate messages, in order that the apparatus may provide a wide variety of questions, answers, automatic score keeping, and other programmable game features in accordance with data and sound recordings made on a recording media, such as a magnetic tape cartridge.

SUMMARY OF THE INVENTION

In accordance with the invention, there is provided an apparatus, usable with a pre-recorded recording media having recorded message representative signals and corresponding recorded location representative signals, for providing an output of a selected one of the message representative signals in response to supplied input signals. The apparatus includes output means responsive to the recorded message representative signals for providing a message output. There are also provided control means, which are responsive to the supplied input for selecting one of the location representative signals and responsive to the detection of the selected location representative signals on the recording medium for selectively controlling the output means to provide an output of the corresponding message signals.

In a preferred embodiment of the invention, the control means comprises a programmed microprocessor. The microprocessor includes a master program for controlling the operation of the device and the recording medium may include additional recorded programming data usable by the microprocessor in accordance with the master program. Accordingly, in a game apparatus of this type, the rules and procedures applicable to a particular game to be played by the operators of the apparatus, can be determined in accordance with programming data which is supplied on the recording medium. This programming data, for example, can be transferred to a random-access memory associated with the microprocessor while the output means which comprises a sound recording output provides the user of the apparatus with instructions concerning the operation of the device in accordance with the programming data which is included on the recording medium.

In a further preferred embodiment of the invention, the apparatus can include second output means for providing a data representative output to the operator or operators of the apparatus. The second output means, for example, can be a numerical display. Where there are provided a plurality of operator-associated input mechanisms, there are also provided a plurality of such numerical displays, one for each operator.

Where the recording medium is a multi-tracked tape recording, data information, comprising programming data, may be stored on one track of the tape while sound recordings, comprising the message information are recorded on another track of the tape.

In accordance with the present invention, there is also provided a recording medium, which is usable with a detecting apparatus having transducer means responsive to recorded locational representative signals, and recorded message signals. The recording medium, includes recordings of location representative signals and corresponding message signals on a storage medium arranged for presentation to the transducer means, so that the transducer means can respond to a control unit and provide an output of the message signal in response to detection of selected location representative signals.

In a preferred embodiment the recording medium can have at least two recording tracks and have location representative signals recorded on a first track and message signals recorded on a second track. The recording medium can also have programming data recorded on it as recorded data for use by the control means.

A preferred embodiment of the apparatus of the invention comprises a game, which is responsive to stored location signals and message signals which are provided on a recording medium. The game includes a transducer which responds to the stored signals, input means for operation by a player for providing control signals, and output means responsive to supplied operation signals for providing an output representative of the message signals. The game includes control means, comprising a programmed microprocessor, which is responsive to the location signals and the control signals, and which selectively provides a portion of the message signals to the output means according to the control signals.

The game can include means for operation by multiple players and may also include second output means for providing an output of numerical representative information to each of the players. The recording medium can also have programming data which can be supplied to the microprocessor in order to establish the method of operation for a particular game.

For a better understanding of the present invention, together with other and further objects, reference is made to the following description, taken in conjunction with the accompanying drawings, and its scope will be pointed out in the appended claims.

DESCRIPTION OF THE INVENTION

Figure 1:
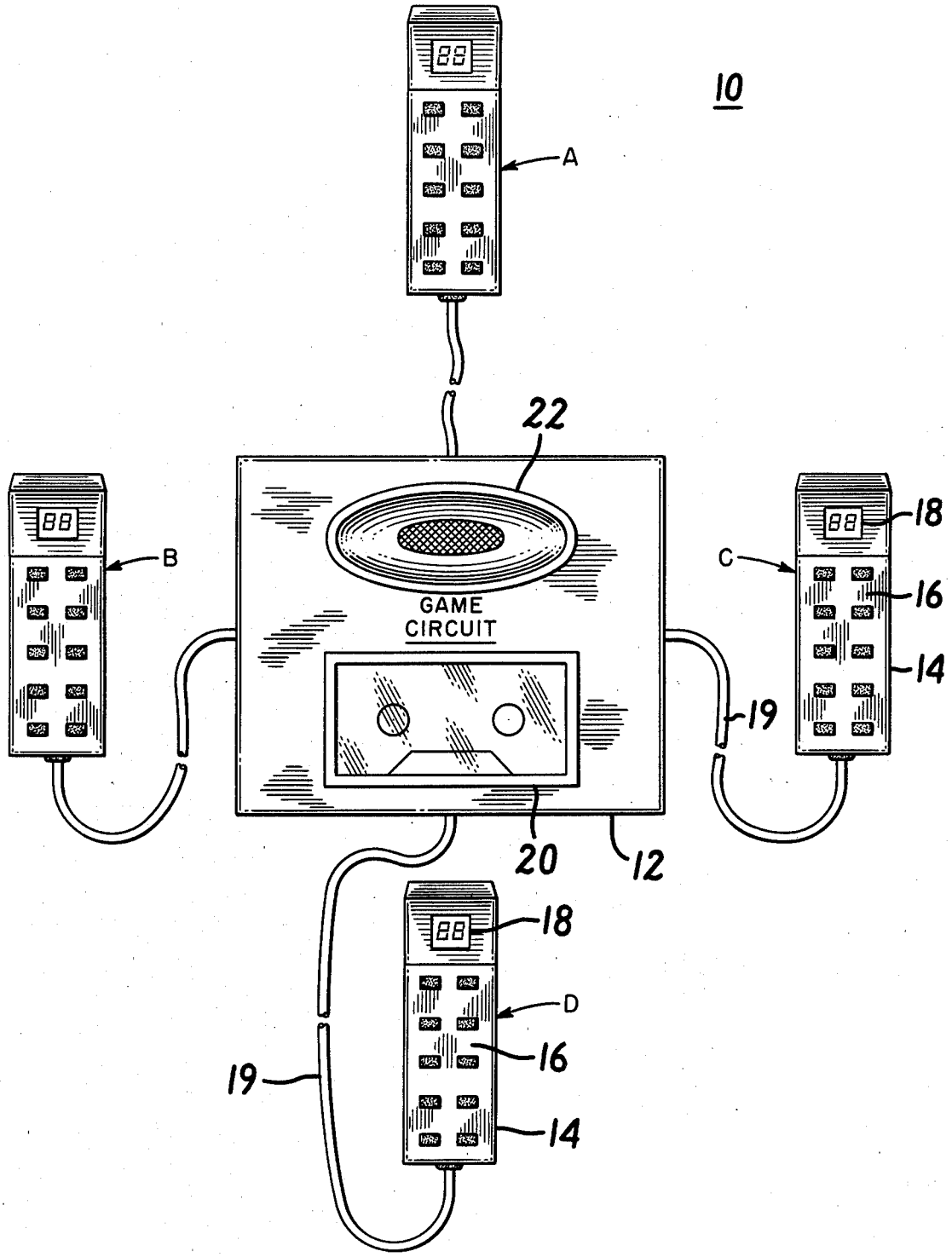
FIG. 1 illustrates a configuration for a game apparatus in accordance with the present invention.

FIG. 1 is an overall view of a game apparatus 10 in accordance with the present invention, which is arranged to be played by up to 4 players. Thus, there are provided 4 players modules 14 indicated as A, B, C and D. Each module 14 is provided with a keyboard 16, including 10 input buttons, and a digital display 18 capable of displaying digital information, such as the individual player's score. The player module 14 is connected to a central game circuit 12 by a cable 19. Game circuit 12 is enclosed in a housing, which includes a tape player 20 and a speaker 22 as well as the essential circuits for the invention as will be described.

In order to understand the circuits used in the present invention, it will be helpful to understand how the game 10 operates, and how it can be used by 1 to 4 players in conjunction with a programmed tape. As indicated above, each player is provided with a module 14 having ten input buttons and a two-digit display, such as may be formed by light emitting diodes.

The game 10 has two major elements, the first is a microprocessor, and the second is a multi-tracked tape player. At the start of the game, the tape player 20 plays a selected tape channel, which has a voice recording which asks the players certain questions by speaker 22. At the same time, a second channel of the tape is read in order to provide question related data, including digital answer information, to the microprocessor. The players answer the questions which have been asked by pressing one or more of the buttons on the respective player modules. The computer receives the answer information from each of the player module keyboards, evaluates that information against the digital answer information which has been received from the second tape channel, and awards points to the players based on the accuracy and/or the speed of their respective responses. The respective scores for each player can be displayed on the two-digit display on each players' module. As an alternate to awarding points to each player, it is possible that each player be assigned a selected number of points at the beginning of the game, and points be added to or taken away from that number according to the answers given by each player.

The invention is most flexible because of the fact that many games can be played depending on the programming data and voice recordings which are recorded on the tape. Thus, there can be provided quizzes, musical recognition games, spelling games, etc. In order to provide for more complete programming, the input buttons may include letters (as on a touch-tone telephone) to enable a player to spell out the answer to a question.

For some games it may be necessary or desirable to provide a hot button on each of the player modules. Thus, only the player who presses the hot button first is permitted to supply the answer, and he gains or loses points according to the correctness. If the given answer is correct the game goes to the next subject, but if the answer is wrong, an additional clue may be given from the information recorded on the tape.

In addition to asking questions associated with any particular game, it is possible through the combined use of digital data processing in the microprocessor, and tape operation, to provide responses according to the players' operation of their respective modules. Thus, for example, the tape may have sequential recordings "red wins, blue wins, yellow wins, and green wins." Only one of these recordings would be played audibly according to which of the players has won the game. The tape recording and control circuits are arranged so that there is provided address information data on a tape channel which is adjacent to corresponding message information. By sensing the address information, the microprocessor knows which one of the multiple alternate recorded messages is adjacent to the tape reader at any particular instant. Thus, it is not necessary to have a random-access tape recorder which is capable of going to a particular tape location in response to a computer command, but it is only necessary for the microprocessor to compare the tape recorded location representative information with the address information which is determined in the microprocessor according to the answer which is given by the player. In this operation, it is possible to have the computer provide electronic tones to the output speaker during the tape transport time corresponding to the undesired messages. Thus, the output may be "ta-ta-ta-ta . . . yellow wins . . . ta-ta". This operation creates an advantageous impact on the players, since they will marvel at the fact that the machine understands what they said, and can talk back accordingly.

Figure 2:
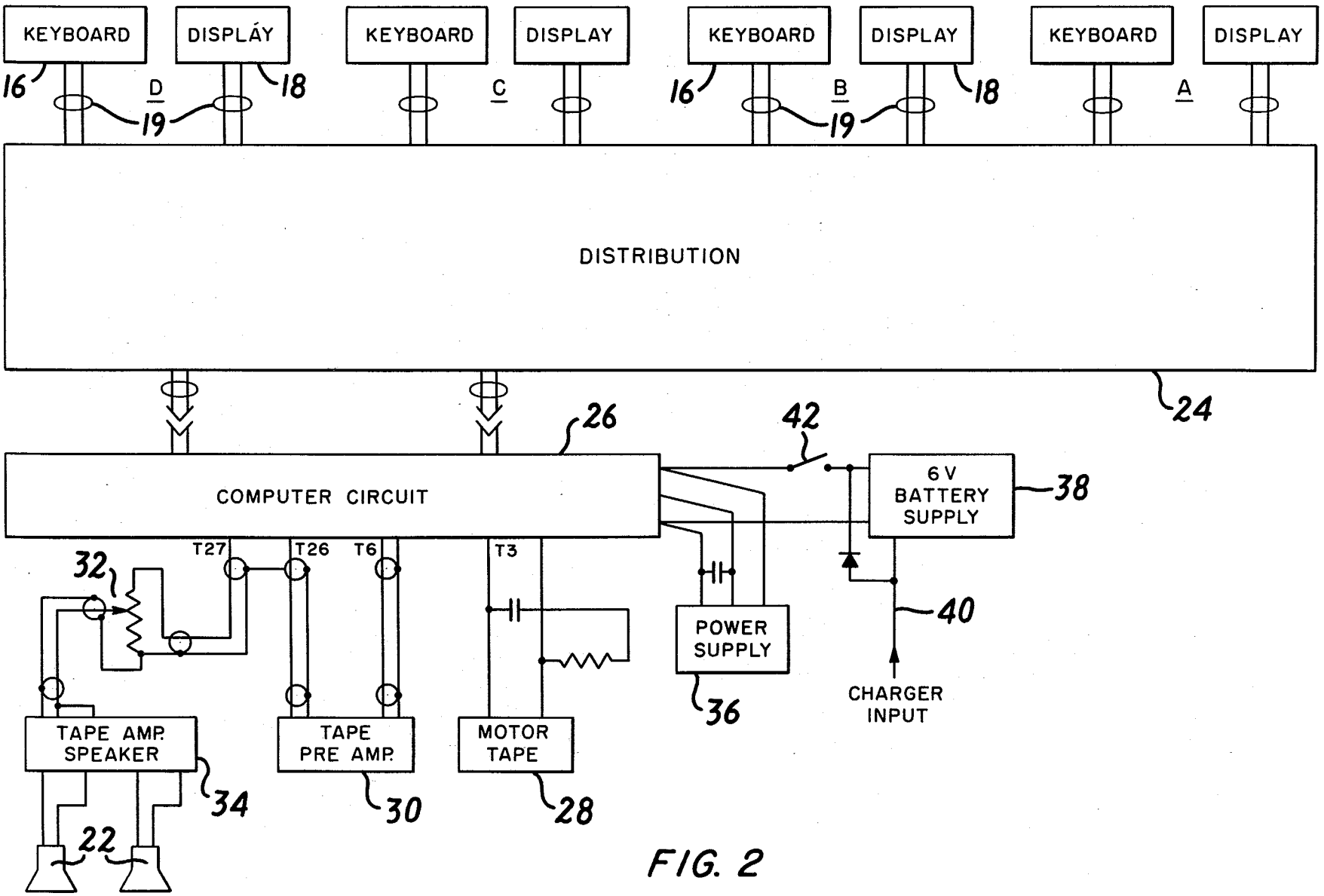
FIG. 2 is a block diagram showing the principal portions of the FIG. 1 apparatus.

FIG. 2 is a block diagram showing the overall circuit arrangement for the game 10 illustrated in FIG. 1. The figure shows a plurality of keyboards 16 and display units 18, which form each player's model 14 shown in FIG. 1. These are connected by cable 19 to the central enclosure 12 of the game within which there are provided the remaining parts of the system. The keyboards and displays are connected to a computer circuit 26 by a distribution board 24 within which the various cables 19 are systematically arranged for transferring data between the keyboards 16 and the display 18, and the computer circuit 26. Connected to the computer circuit 26 is the tape player, which includes a motor 28, for operating the tape transport mechanism, a tape preamplifier 30 has first and second channels for picking up information which is recorded on the tape either in audible form or in data format. There is also provided an output amplifier 34 for operating the speakers 22. Output amplifier 34 is connected to the computer circuit 26 by means of a volume control potentiometer 32. Also adjacent to the computer circuit 26 and connected thereto, there is provided a battery circuit 38, with a charger input 40, and off/on switch 42. A power supply 36 is also provided for supplying the various voltage levels required for operation of the microprocessor and tape recorder equipment.

Figure 3A:
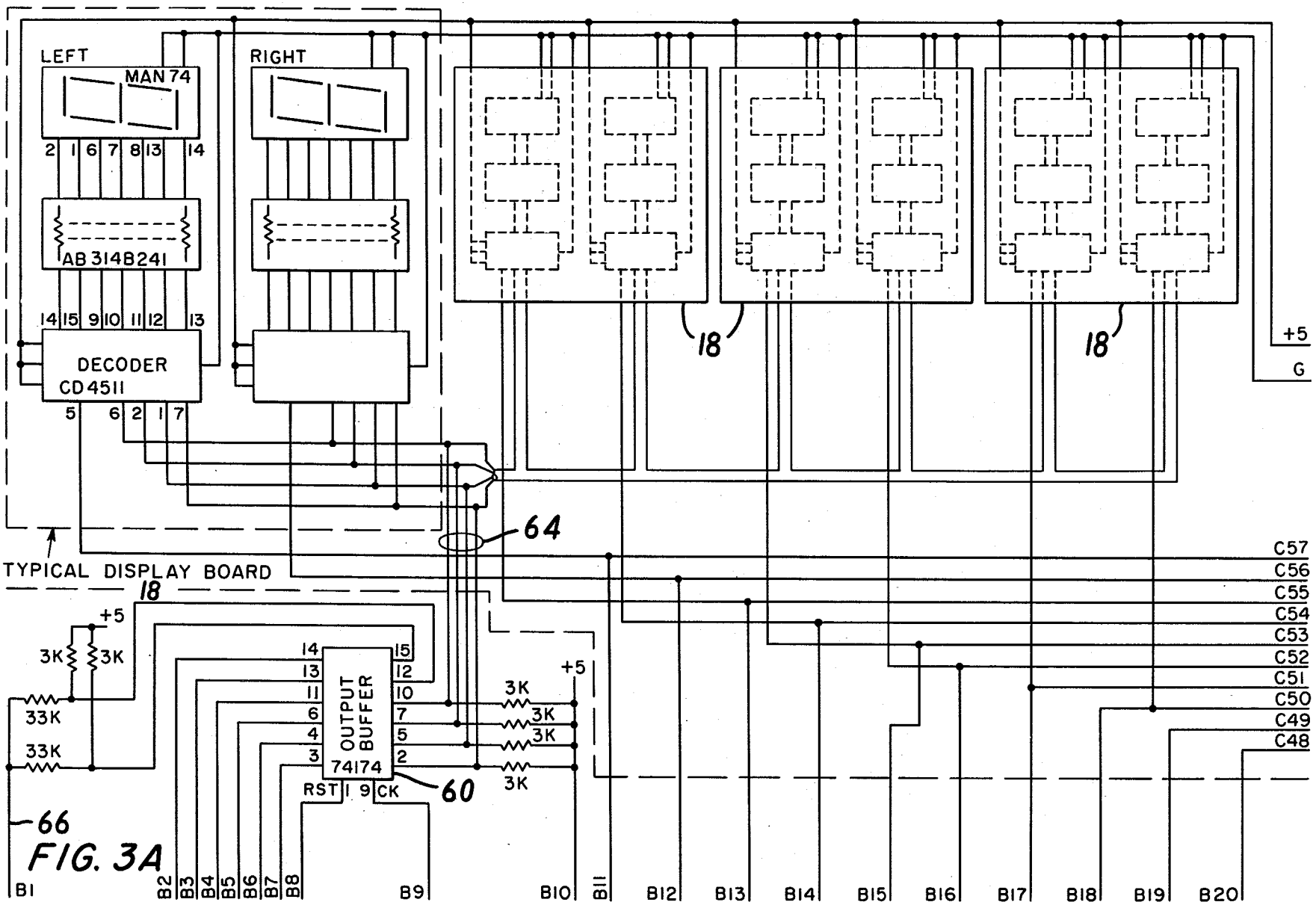
FIGS. 3A, 3B and 3C, combined comprise a circuit diagram for the apparatus of FIG. 1.
Figure 3B:
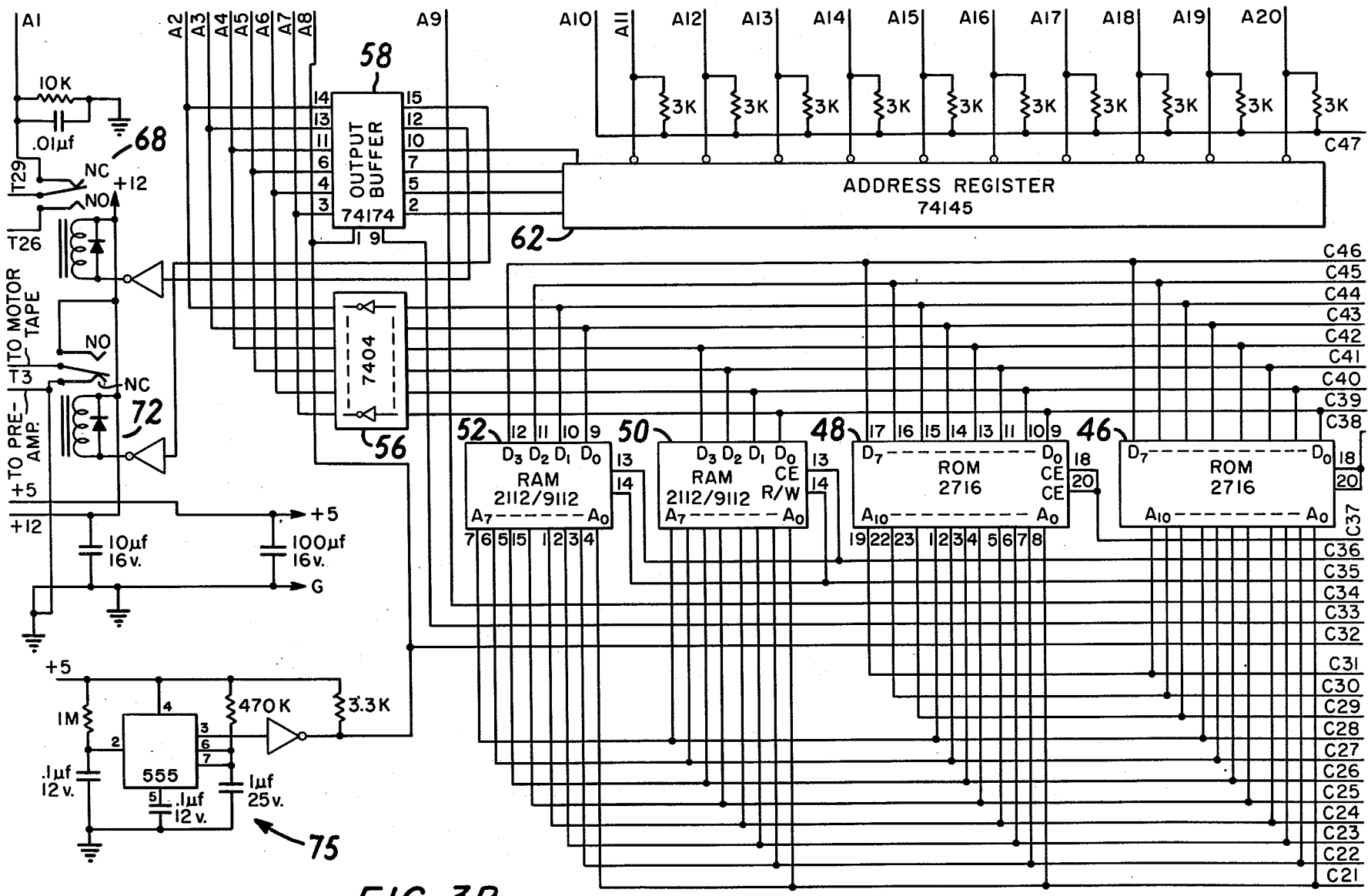
Figures 3A, 3B, 3C:
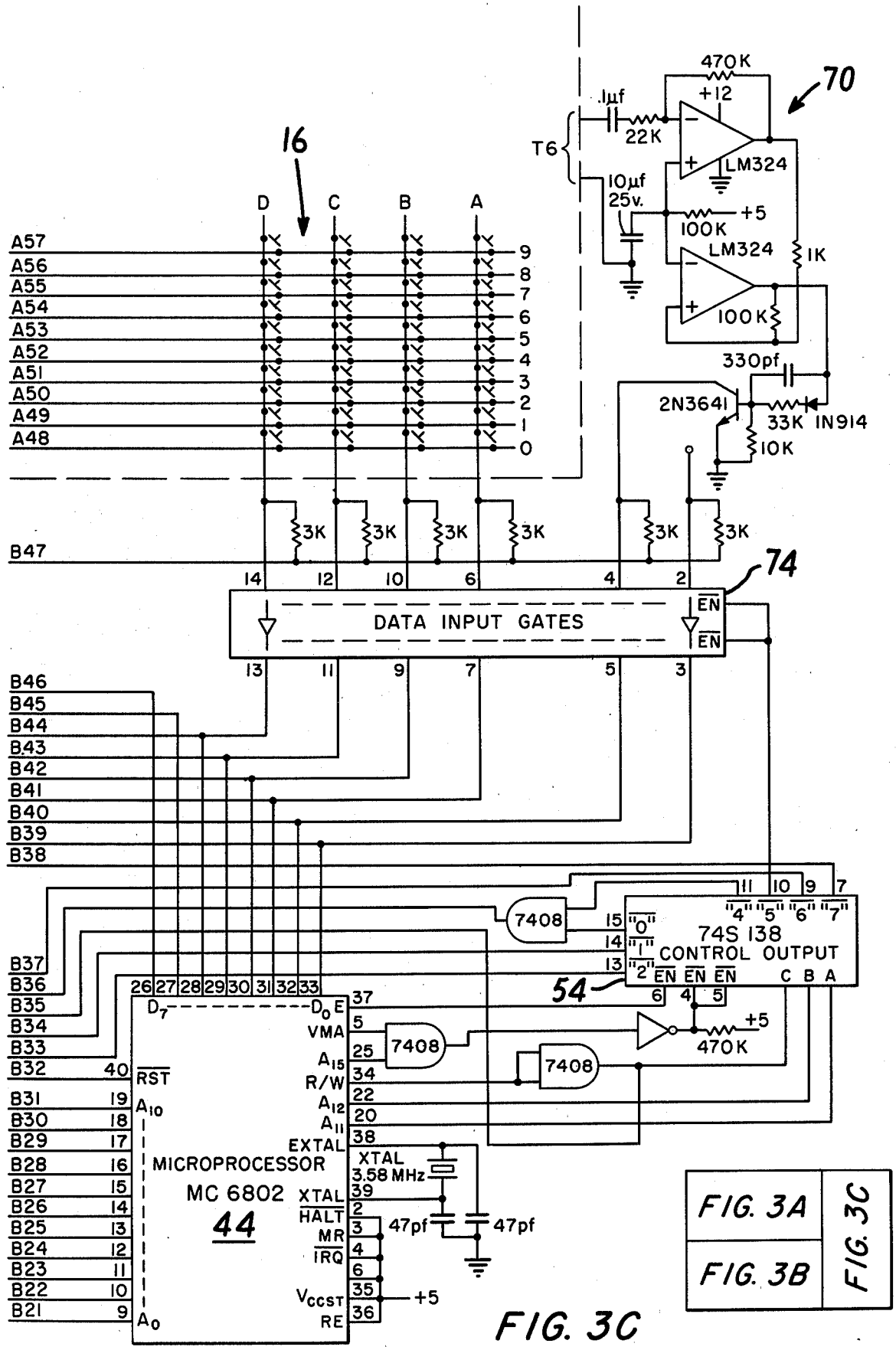

The computer circuit, which is the heart of the present invention, is illustrated in detail in FIG. 3 which consists of three parts labelled FIGS. 3A, 3B and 3C. The interconnecting wires which run between each of the three parts of FIG. 3 are labeled with a letter designating the part of the drawing to which the wire goes and a number indicating the number of the interconnecting wire. Corresponding numbers occur on the drawing to which the leads transfer. In FIG. 3C at the lower right hand corner, there is illustrated an arrangement by which FIGS. 3A, 3B and 3C may be placed together to achieve an overall circuit diagram.

The FIG. 3 circuit is composed almost entirely of integrated circuit components, each of which is labeled with its designating number. The heart of the circuit is the microprocessor 44 which is a Motorola MC 6802 Microprocessor. The microprocessor is provided with two read-only memories (ROM'S) 46 and 48 which contain the required reference data and the microprocessor operating program. This program is the master system program which responds to programming data which may be provided by reading data on the tape recording. The master program can be varied according to the game programming data provided on the tape. Thus, the system responds to recorded data, not only to obtain reference data relating to answers to questions which are being asked by the recorded voice message on the tape, but also in order to obtain other data which may vary the operation of the tape recording system, the scoring, and other parts of the game.

Also connected to microprocessor 44, are random-access memories (RAM'S) 50 and 52. These memories are used in order to store ephemeral data during the operation of the program, for example, the correct answer to a question may be stored in this memory. Also, the answers input by the various players may be stored in this memory pending comparison of these answers with the correct answer by the microprocessor. These memories can also be used to store the players' scores for later display on the output display 18.

The circuit of FIG. 3 includes output data inverters 56 and output data and address buffers 58 and 60. Output buffer 58 provides address signals to the address register 62, which determines which of the output displays 18 will be activated in response to data provided by output buffer 60. Likewise, addressed register 62 determines which of the input buttons 16 will be sensed by input gates 74 during an input cycle of the computer operation.

Output buffer 58 also provides control signals for operating relays 68 and 72. Relay 68 controls the flow of sounds to the speaker from either the computer output, by means of output buffer 60, or directly from the message track of the tape being played. Likewise, relay 72 controls the starting and stopping operation of the tape transport motor. Output buffer 60 provides computer generated tone signals to the speaker through relay 68, and also provides numerical output to the displays on display boards 18. The numerical output data is provided over data lines 64, and the individual display to be activated by the data on lines 64 is determined by the output of address register 62.

Input gates 74 respond to data which is input by depressing the buttons on keyboards 16. The buttons are polled during an input cycle by address register 62. Input gates 74 also receive input data which is detected on the magnetic tape and provided to the computer circuit over terminal T6. Input amplifier 70 is provided to bring the signal level of the input data to the TTL compatible data format which is required by the microprocessor.

The control output circuit 54 comprises a decoder circuit, which decodes the output control signals from microprocessor 44, determines from the decoded signals which of the memories, input or output devices are to be activated; and provides an activating signal to those devices. Thus, in response to signals provided to input pins A, B, and C, control output circuit 64 may activate the input gates 74, one of the read-only memories 46, 48, one of the random access memories 50, 52, or one of the output buffers 58, 60, of the computer circuit.

Those skilled in the art will recognize that operation of the game will require programming instructions which are to be supplied in read-only memories 46 and 48, and which serve to operate microprocessor 44. A print out of an appropriate microprocessor program for providing game operation as described using the FIG. 3 circuit is appended to this specification as Appendix I. Appendix II is a sample of scripts useful for games to be played with the FIG. 1 apparatus.

Figure 4A:
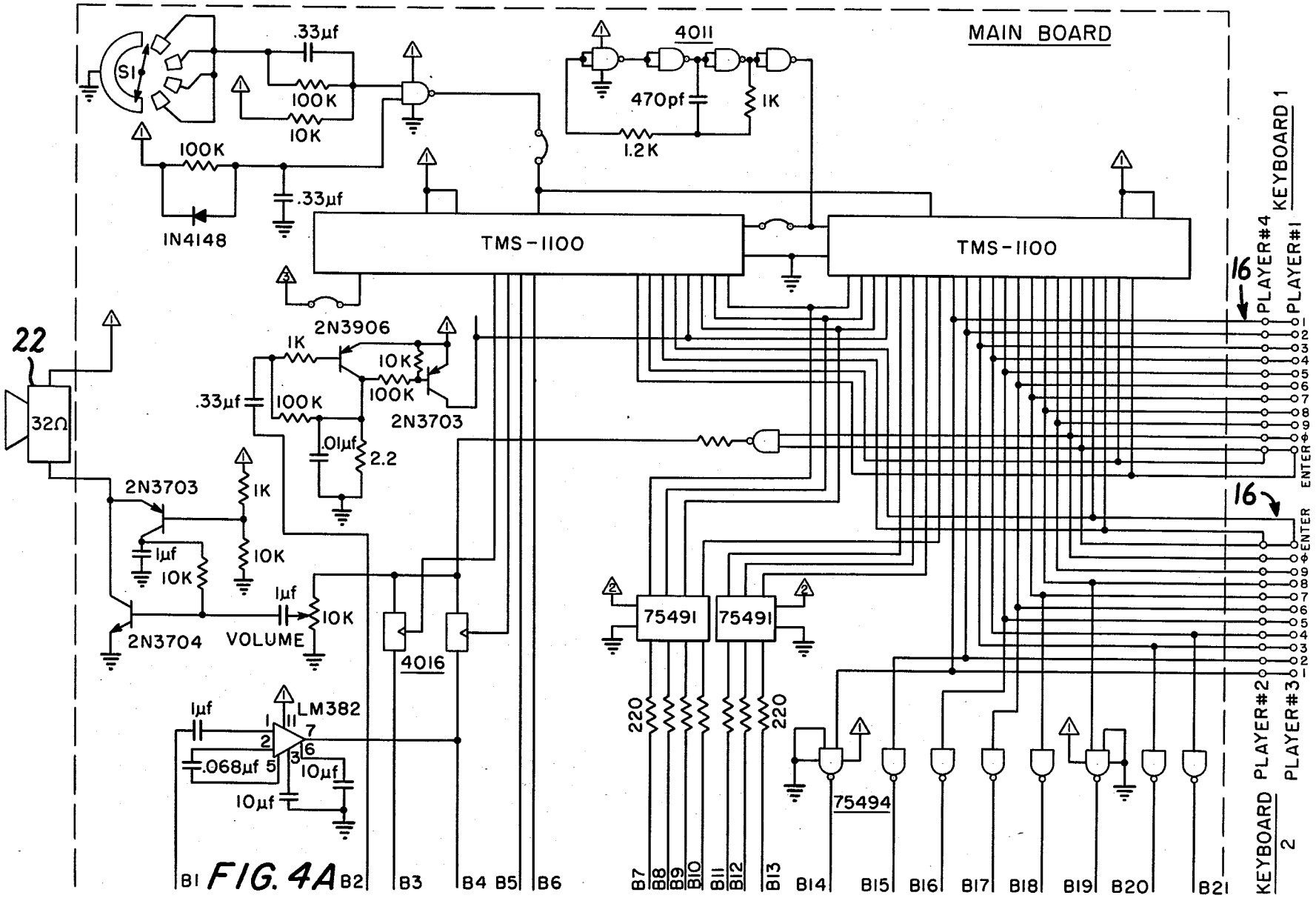
FIGS. 4A and 4B, combined comprise a circuit diagram for an alternate embodiment of the apparatus of FIG. 1.
Figures 4A, 4B:
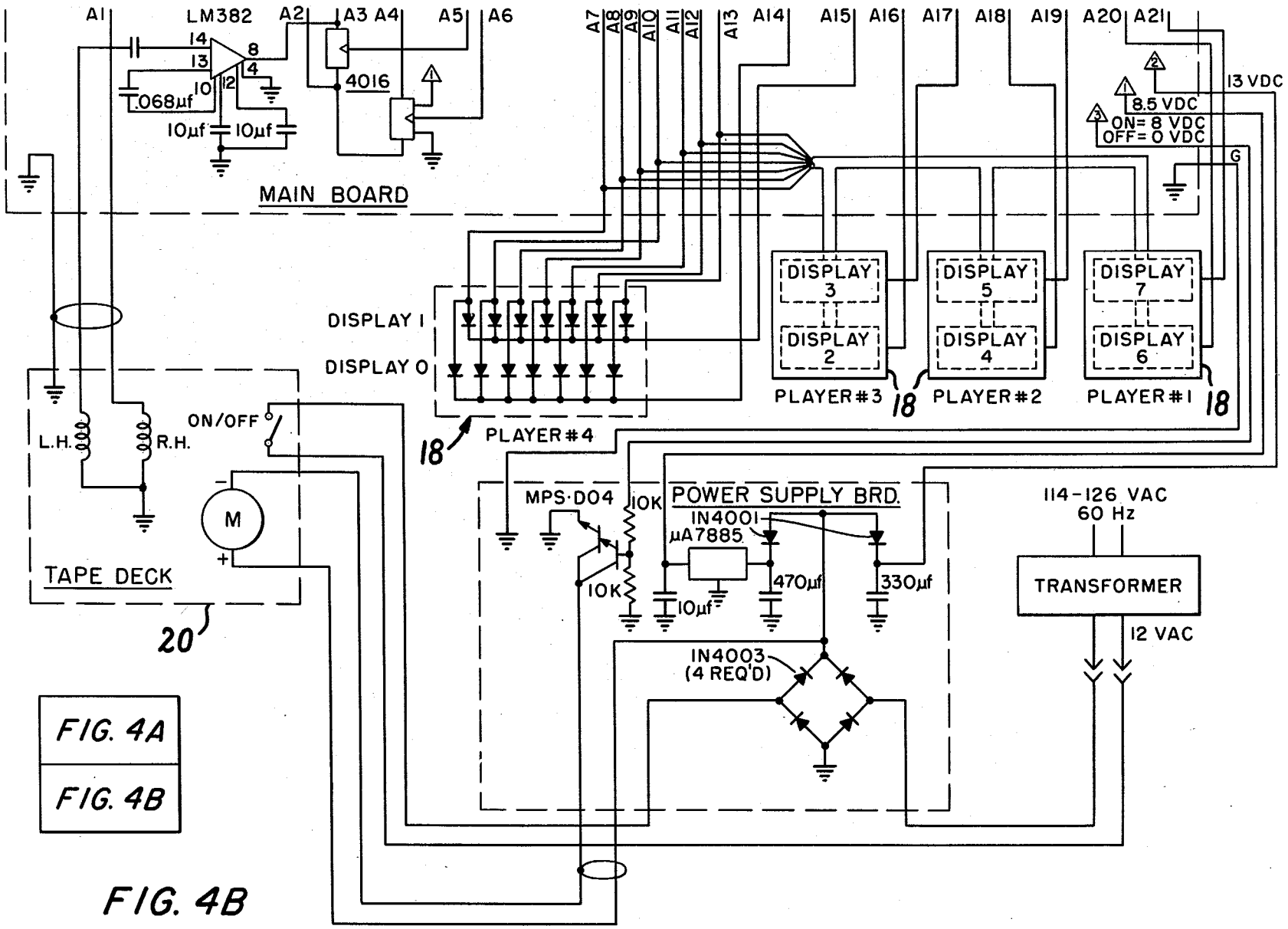

FIG. 4 is a diagram of an alternate computer circuit, usable for the game of the present invention. Whereas the FIG. 3 circuit makes use of a 6802 Microprocessor, and peripheral memories, which are interconnected to the microprocessor by use of address and data buses, the circuit of FIG. 4 makes use of dual TMS 1100 microprocessor units, which eliminate the need for many of the peripheral integrated circuits. In the circuit of FIG. 4, the input, output and control buffering are provided within the microprocessor unit. In addition, the microprocessor unit contains adequate memory capacity to store the control program and the ephemeral data required for circuit operation. Further, the decoding of signals for the display output 18 is accomplished within the microprocessor itself.

Those skilled in the art will recognize that the microprocessor unit illustrated in FIG. 4 will require a different control program than that used for the FIG. 3 circuit which is set forth in Appendix I. It will be recognized, however, that translating and adapting the program for use in a different microprocessor is a task within the skill of those ordinarily skilled in the microprocessor art.

Another distinction found in the FIG. 4 circuit is the fact that much of the output amplifying circuits are provided on the same circuit board as the microprocessor. Also, the circuit is arranged so that, according to the operating of the control program provided in the microprocessor, data from either track of the tape can be provided to the speaker or provided to the microprocessor. Thus, a particular track on the tape may contain intermixed data and audible messages, and the system can be programmed to handle the sequential data and messages, and provide the messages to the output speaker, as appropriate, while the data is being provided to the microprocessor, as appropriate.

APPENDIX II

How Lovable Are You?

Are you the kind of person that just about everybody wants to be around? Are you warm, sensitive, thoughtful? What is your lovability quotient? If you take our quiz, you'll find out just how lovable you are. Be sure to answer truthfully and select the reponse that most closely approximates your reaction to a particular situation.

Question #1—Someone is in a position to do you a favor that would save you hours of trouble and aggravation. You would . . .

1. Ask him nicely for the favor and not be too upset if he refuses.
2. Explain carefully how much you need his help—feeling sure he'll come through.

3. Not ask for his help because you don't like imposing on people.

Question #2—The group that you are with starts criticizing a good friend of yours. Most likely you would . . .

1. Defend him fiercely
2. Defend him, but in a pleasant conciliatory way.
3. Walk away.

Question #3—You love going to new places and trying new things. Do you . . .

1. Agree
2. Partly agree
3. Disagree

Question #4—Are you self-conscious when meeting new people?

1. At the beginning, yes, but I soon get over my fears.
2. Yes, usually, but I try to be outgoing so that no one will notice.
3. Only when I'm introduced to someone who is a celebrity of some kind.

Question #5—People occasionally try to take advantage of you. Do you . . .

1. Agree
2. Partly agree
3. Disagree

Question #6—Which of the following comes closest to describing your social life?

1. You are part of a large loose-knit crowd which gets together frequently.
2. You mostly associate with a small circle of very close friends.
3. You have a circle of pleasant acquaintances.

Question #7—You look forward to parties and usually have a good time at them. Do you . . .

1. Agree
2. Partially agree
3. Disagree

Question #8—How good are you at keeping secrets?

1. Terrible, I just can't keep anything secret.
2. Pretty good, I can be discreet if I have to.
3. If a friend has persuaded me that the secret is important, then torture wouldn't drag it out of me.

Now, if your score is flashing, you have more than 22 points.

Your lovability quotient is 100% . You have a sunny disposition and an up-front "Take me or leave me" personality few can resist. In your company stuffy people unwind and become human, the elderly feel young and skinflints suffer bursts of generosity. Your biggest problem is that too many people fail to take you seriously because of your upbeat personality.

If your score is flashing, you have 15 to 21 points and your lovability quotient is 60%. You are lovable, but only to the people who are more or less on your wavelength. You are thoughtful, amusing and a considerate friend. In your circle of friends, you are extremely well-liked. Since friendship comes harder to you than to some people, you tend to hang onto your friends and many of your friends are people you have known a very long time.

If your score is flashing now it's under 15 points. What you want from the world is respect rather than popularity, and you usually get it, most of your time is spent with a select group of friends whose characters, abilities and achievements you admire. Your goals in life are high, and you mean to accomplish them.

Academy Award Winning Songs

How many songs can you remember that have actually won the much sought-after Academy Award? Most of these songs will probably sound familiar but you may not have known that they were Oscar winners. Once the song begins to play, you will have 15 seconds to guess the title—Hit the hot button on your right and enter the first letter of your answer.

(1) This first song captured the Academy Award for the year 1976. Do you recall the name of the song that won that year? Are you ready?

The Academy Award-winning song for 1976 was Evergreen, sung by Barbara Streisand in "A Star is Born".

(2) Let's go back to the year 1966. This song is still heard today on radio and t.v.

*Born Free*, and still as beautiful as ever.

(3) This very popular song, which you heard at the beginning of the game won the Academy Award in 1969.

*Raindrops Keep Falling on my Head*, is correct.

(4) This is another winner from the year 1971.

The title of that song was *Shaft*.

(5) This was a very popular song in 1961 and also the Academy Award winner for that year.

The name of the Oscar winning song for 1961 was *Moon River*, the theme song for the movie, Breakfast at Tiffany's.

How about a real challenge for the last song of this game?

(6) This was the very first Academy Award—winning song going all the way back to the year 1934.

*Continental*—Won in the first Academy Award. The movie was Gay Divorcee with Fred Astaire and Ginger Rogers.

Congratulations, you are the winner, red, blue, green, yellow.

Roady 100 Math Facts Racing Game

Welcome to the Roady 100, the most important race of the Math Facts Racing Circuit!!!!!

You will be competing today for the Roady 100 championship! May the best racer win!!!!

The fans have been here since 5 o'clock this morning and they are getting restless. The race will start at 11:00. How many hours will they have been waiting for the race to begin? Hit the hot button on your right as soon as you think you know the answer.

6 hours

The Roady 100 track is 2 miles in length. If each length or lap is 2 miles and the drivers have to complete 50 laps, how many miles do they have to drive in all?

100 miles is the correct answer.

Only 33 drivers are allowed to qualify for the race. They are lining up in rows of 3 cars each. How many rows of racing cars will there be in all?

If you guessed 11 rows you are correct.

Wait! I see the starter, he's lowered the green flag

The race has begun!!!! Thirty-three cars practically fly by the stands. All of the drivers are pushing hard. Twenty of the thirty-three drivers have now made it through the first turn. How many drivers have not made it through the turn yet?

Thirteen drivers have not reached the turn yet.

The cars are going at breakneck speed. What's happened? Car #4 is pulling out of the pack! It looks like there is something wrong with the left rear tire. That means a pit stop for car #4. The pit crew can change one tire in 1 minute. How long would it take them to change 2 tires?
2 minutes for 2 tires to be changed.

The lead car has been clocked at 190 miles per hour. The second car has been clocked at 180 miles per hour. How much faster is the lead car going?
The lead car is going 10 miles per hour faster.

Twenty minutes have now gone by and the lead car has just completed 30 laps. The last car in the race has only completed 20 laps. How many laps is the last car behind the lead car?
The last car is 10 laps behind.

The checkered flag is down! The roady 100 is over!!!! It's been a great race. Congratulations to the winner of an exciting and well run race!!!! The winner is red, blue, green, yellow

Family Feud

This game is based on the popular TV show, Family Feud. As you probably know, Family Feud is a game in which players compete to guess the most popular answers selected by a previously polled audience. In this version of the game you will be given the top four answers selected by the audience. The tricky part of this game is that you will have to decide which answer was the most popular answer, the next most popular and on down to the least popular answer. Two points will be given for every answer that is guessed correctly. There will be a bonus of 5 additional points every time a player gets all four responses in the proper order. Let's begin—

Question #1—name a sound made by one of the animals on Old McDonald's Farm.

The top four responses were, not necessarily in this order:
quack
oink
cluck
moo I will read them again and this time you must press a number from 1 to 4 to indicate the popularity of that particular answer
quack—Did you press a number?
oink
cluck
moo The answers in order of popularity were:
#1—moo
#2—oink
#3—quack
#4—cluck Question #2—100 children were asked: name something you can do when you're grown-up that you can't do now. The top four responses were:
get married
drive
work
drink As you hear them again, press a number from 1 to 4 to indicate the popularity of a particular answer.
get married
drive
work
drink You might be surprised at some of these. The answers in order of popularity were:
#1—drive
#2—drink
#3—work
#4—get married Question #3—name a TV show that is named after it's animal star:

The responses were:
Flipper
Gentle Ben
Fury
Lassie

I will read them again. Select your numbers accordingly.
Flipper
Gentle Ben
Fury
Lassie The answers in order of popularity were:
#1—Lassie
#2—Gentle Ben
#3—Flipper
#4—Fury The Family Feud champion is red—blue—green—yellow.

Quickie Quiz

This game is a collection of many different types of questions to test both your knowledge and your reflexes. Get ready for a fast and furious game! The player who answers each question correctly and fastest gets a point.

Question #1—spell the word vacuum
the correct spelling is v-a-c-u-u-m

Question #2—how many continents are there in the world?
7

Question #3—what one letter in the alphabet is same as a certain green vegetable?
the letter "P"

Question #4—this is a series of numbers: 16, 24, 32 . . .
What is the next number?
number 40

Question #5—what two letters represent the abbreviation for the empire state?
the letters are N and Y Question #6—this is a riddle—what has a face and never washes it?
a clock The leader right now is red, blue, green, yellow.

Question #7—spell aardvark
a-a-r-d-v-a-r-k

Question #8—what color do you get if you mix blue and yellow?
green

Question #9—how many reindeer were there in the poem, "Twas The Night Before Christmas." by Clement C. Moore?
8 reindeer Question #10—how many points does a football team score when it makes a safety?
2 points Question #11—what should people in a certain kind of house not throw?
stones Question #12—in our solar system, what planet is the furthest from the sun?
pluto Question #13—I am going to read a number to you. How fast do you think you can type it in? The number is
39
Let's try a 3 digit number such as
157
Let's try one more—a 4 digit number
2186
Question #14—complete this proverb A is as good as a mile.
a miss is as good as a mile.
Question #15—this state is called the buckeye state.
Ohio
Question #16—how good are you at figures? Let's see how you do with this one. Start with the number 12,
Add 12 to that.
Subtract 5.
Add 1.
Divide by 2.
Multiply by 10.
What is your answer
100
Question #17—spell ghost backwards
tsohg
Question #18—what is the longest river in the world?
the longest river is the Nile
You all played a wonderful game!! You are to be congratulated.
But the winner is red, blue, green, yellow.

TV Trivia

Welcome to our TV trivia game! How well do you remember television from the 50's and 60's?

In this game, each player starts out with 10 points. Depending upon how sure you are of your memory, you may bet from 1 to 5 points on a question, player who lost his 10 points is out of the game. Are you ready to step back into television history? Let's begin!

Question #1—one of James West's arch rivals in the television show Wild, Wild West was . . . You may place your bets now
1. Pierre Gaspar
2. Artemus Gordon
3. Dr. Loveless
4. none of the above.
If you guessed #3, Dr. Loveless, you were correct. His Full name was Dr. Miguelito Coyote Loveless and he was played by the actor Michael Dunn.

Question #2—she played "Cricket" in the detective show, Hawaiian Eye.
Place your bets.
1. Connie Francis
2. Connie Stevens
3. Anne Francis
4. none of the above
the correct answer is #2 Connie Stevens.

Question #3—in this spy spoof, Get Smart, Max and agent 99 continually battled wits against the enemy organization known as:
1. K.A.O.S.
2. U.N.C.L.E.
3. S.N.A.R.L.
4. none of the above
the correct answer is #1 K.A.O.S.
Red, blue, green, yellow—you are ahead.

Question #4—she was the "sock-it-to-me" girl on Laugh-In. This is a bonus question which means that you may bet from one to ten points as long as you don't bet more than your present score. Place your bets and good luck on this one.
1. Goldie Hawn
2. Theresa Graves
3. Ruth Buzzi
4. none of the above.
That was sneaky wasn't it? If you answered #4 none of the above, you were correct because the "sock-it-to-me" girl was none other than Judy Carne.

The winner and unofficial T.V. trivia champ is red—-blue—green—yellow.

This is Inword

How good are you at unravelling mysteries? In this game the mystery is a word which you will try to guess from the clues that I give you. The mystery word can be the name of a person, place, or thing. Within this word is another unrelated word which is called the inword. For example: In the word "chocolate", the inword is "late".

Are you ready? Let's play . . .

This mystery word has 5 letters. The inword is bow, b-o-w, can you guess the mystery word? Remember, it has 5 letters.

Very good!!!! You guessed the mystery word! Yes, the correct word is elbow, e-l-b-o-w. You've done so well with that word, let's try another one.

Since no one had the right answer, go to the first clue . . . The first clue is "macaroni".

Very good! You guessed the mystery word! The correct word is elbow, e-l-b-o-w.

Sorry, since no one had the correct answer, let's go to the second clue . . .

The second clue is "arm".

Very good! You guessed the mystery word! It's elbow, e-l-b-o-w-.

Sorry, since no one had the correct answer you'll get one more chance. Let's go to the third and last clue.

The third and last clue is: The first letter is "e".

Right, the mystery word is elbow, e-l-b-o-w. Better luck next time. The mystery word is elbow, e-l-b-o-w. Are you ready to try again?

This mystery word has 6 letters. The inword is mat, m-a-t. Can you guess the word?

Very good! You guessed the mystery word!! Yes, the correct word is tomato, t-o-m-a-t-o.

Sorry, that was incorrect. Let's go to the first clue.

The first clue is "It's in the sauce".

You guessed the mystery word! It's tomato, t-o-m-a-t-o.

Sorry, that was incorrect. Let's go to the second clue . . .

The second clue is "Love apples".

Very good! The mystery word is tomato, t-o-m-a-t-o.

Sorry, that was incorrect. You get one more chance. Let's go to the third and last clue.

The third and last clue is: The last letter is "o".

That is correct. The mystery word is tomato, t-o-m-a-t-o.

Well, better luck next time. The mystery word is tomato, t-o-m-a-t-o.

The winner of the game is blue, red, green, yellow.

Sorry, we have no winner in this game.

"When you're as great as I am, it's hard to be humble." Who do you think might have said that? Was it Pete Rose? Jimmy Connors? Howard Cosell, maybe? Actually the author of that statement was none other than Muhammed Ali.

In this game I will give you a quote such as the one you just heard, along with the names of 3 individuals who might have been responsible for that quote. Are you ready? Let's begin.

(1) The first quote is: "That's one small step for mankind." Who said that?

1. Wilt Chamberlain
2. Doctor Scholl
3. Dr. Benjamin Spock
4. none of the above.

The correct answer was #4, none of the above because the real author of that statement was, of course, Neil Armstrong, the first astronaut to walk on the moon.

(2) The next quote is: "There is nothing I love as much as a good fight".

1. Franklin Roosevelt
2. Sylvester Stallone
3. Richard Nixon
4. none of the above

#1, Franklin Delano Roosevelt.

Well, let's look at the standings, the leader now is red, blue, green, yellow—but the game isn't over yet.

(3) The third quote is: "I never met a man I didn't like." The author of that quote was:

1. Dwight Eisenhower
2. Will Rogers
3. Mae West
4. none of the above

It was #2, Will Rogers, the well-known humorist, who made that observation about his feelings for mankind.

(4) The next quote is probably a familiar one to you, but do you know who actually said it? "Nice guys finish last."

1. Bruce Jenner
2. Leo Durocher
3. Don Rickles
4. none of the above.

That quote was issued by #2, Leo, "the lip" Durocher, a well-known baseball personality in the 50's and 60's. And now it's time to announce the winner. The winner is red, blue, green, yellow.

Definitions

Welcome to the game of daffy definitions and meandering meanings. In this game each player starts out with 10 points. For each correct answer you will add 2 points to your score; for each incorrect answer you will lose 2 points. Are you ready? Let's begin . . .

Question #1—The word laconic, l-a-c-o-n-i-c means:

1. having cow-like ears
2. easily broken
3. sparing of words
4. none of the above

#3, sparing of words, is correct. You were right—red—blue—yellow—green

Question #2—The word brogan, b-r-o-g-a-n means:

1. an Irish toast
2. a work shoe reaching to the ankle
3. a horse kept for breeding
4. none of the above The correct answer is #2, a work shoe reaching to the ankle.

Question #3—The word garble, g-a-r-b-l-e means:

1. to rinse the throat with liquid
2. a very small man
3. to roam about aimlessly
4. none of the above The correct answer was #4, none of the above because garble means to distort the meaning or sound of.

Question #4—A smidgen, s-m-i-d-g-e-n is:

1. a small stout-bodied bird
2. a small amount
3. a short man-like ape of southeastern Asia
4. none of the above

#2, a small amount.

Question #5—The word punctilious, p-u-n-c-t-i-l-i-o-u-s means:

1. capable of making small holes
2. having few or no teeth
3. meticulous
4. none of the above

#3, meticulous is correct!

The winner and word expert of this game is red/blue/green/yellow:

While they have been describe what are believed to be the preferred embodiments of the present invention, those skilled in the art will recognize that other and further modifications may be made thereto without departing from the spirit of the invention, and it is intended to claim all such embodiments as full within the true scope of the invention.

I claim:

1. A multiple-player game apparatus, comprising:

a magnetic tape having recorded thereon sound signals, game program signals and location signals;

a magnetic tape playing apparatus having a tape motor for transporting said tape past a magnetic signal transducer, said tape motor being operative in response to motor control signals, said player providing output signals representative of said recorded sound signals, game program signals and location signals;

sound output apparatus responsive to supplied audio signals for providing a sound output;

a relay, responsive to output control signals, for selectively supplying said output sound signals or generated audio signals as audio signals to said sound output apparatus;

a plurality of keyboards, one for each of said multiple players, for generating input signals in response to key operations;

a plurality of alphanumeric display units, one for each of said multiple players, responsive to supplied numeric output signals;

a read-only-memory having a master system program;

a random access memory;

and a microprocessor, coupled to said read only memory, said random access memory, said tape playing apparatus, said sound output apparatus, said relay, said keyboards and said display units, said microprocessor being operative in response to said master system program to:

(1) supply motor control signals to said tape motor;

(2) store in said random access memory game program signals supplied by said magnetic tape playing apparatus;

(3) operate under said master program and said stored game program to supply output control signals to said relay to cause said relay to supply said output sound signals to said sound output apparatus;

(4) operate, under said control program and said game program, and in response to said position signals supplied by said tape playing apparatus, to supply motor control signals to said tape motor to stop said tape motor at selected tape positions;

(5) operate under said control program and said game program, and in response to said input signals from said keyboards, to supply numeric output signals to said display units;

(6) operate under said control program and said game program, and in response to said input signals from said keyboards, to supply motor control signals to said motor to start said motor;

(7) operate, under said control program and said game program, and in response to said input signals and said position signals, to supply output control signals to said relay to cause said relay to supply selected portions of said sound signals to said sound output apparatus; and (8) operate, under said control program and said game program, in response to said input signals and said position signals, to generate audio signals and to supply output control signals to said relay to cause said relay to supply said generated audio signals to said sound output apparatus.

* * * * *